United States Patent [19]

Best et al.

[11] 4,435,967

[45] Mar. 13, 1984

[54] DOORKNOB

[75] Inventors: Walter E. Best; William R. Foshee, both of Indianapolis, Ind.

[73] Assignee: Best Lock Corporation, Indianapolis, Ind.

[21] Appl. No.: 361,989

[22] Filed: Mar. 25, 1982

Related U.S. Application Data

[63] Continuation-in-part of Ser. No. 270,825, Jun. 5, 1981, Pat. No. 4,394,821, which is a continuation-in-part of Ser. No. 136,746, Apr. 2, 1980, abandoned.

[51] Int. Cl.[3] ..... E05B 63/10

[52] U.S. Cl. ..... 70/224; 70/216

[58] Field of Search ..... 70/224, 216, 380, 381, 70/DIG. 62, 215, 372, 373; 292/347

[56] References Cited

U.S. PATENT DOCUMENTS

| | | | |
|---|---|---|---|
| 2,082,351 | 6/1937 | Moore | 70/224 |
| 2,547,439 | 4/1951 | Cerf | 70/224 |
| 2,677,953 | 5/1954 | Fisher | 70/224 |
| 2,713,257 | 7/1955 | McConnell | 70/224 |
| 3,955,387 | 5/1976 | Best et al. | 70/224 |

OTHER PUBLICATIONS

Ser. No. 136,746, filed 4/2/80 by Best et al.
Ser. No. 163,472 filed 6/27/80 by Foshee.
Ser. No. 270,825 filed 6/5/81 by Best et al.

*Primary Examiner*—Robert L. Wolfe
*Attorney, Agent, or Firm*—Barnes & Thornburg

[57] ABSTRACT

A doorknob has a large end face opening in which a face plate is fixedly but rotatably mounted. The face plate contains within itself a figure-8 or other non-circular opening for the reception of a removable key-operated core having a key plug housing and a radially extending pin tumbler flange or lobe. Te knob interior is formed with radially inward-extending portions which define diametrically opposite notches or grooves in which the pin tumbler flange or lobe of the core is optionally engageable as a spline to key the core and face plate to the knob in either of two opposite orientation to suit installations of the knob and its lock set in doors of different hand.

10 Claims, 3 Drawing Figures

FIG. 1
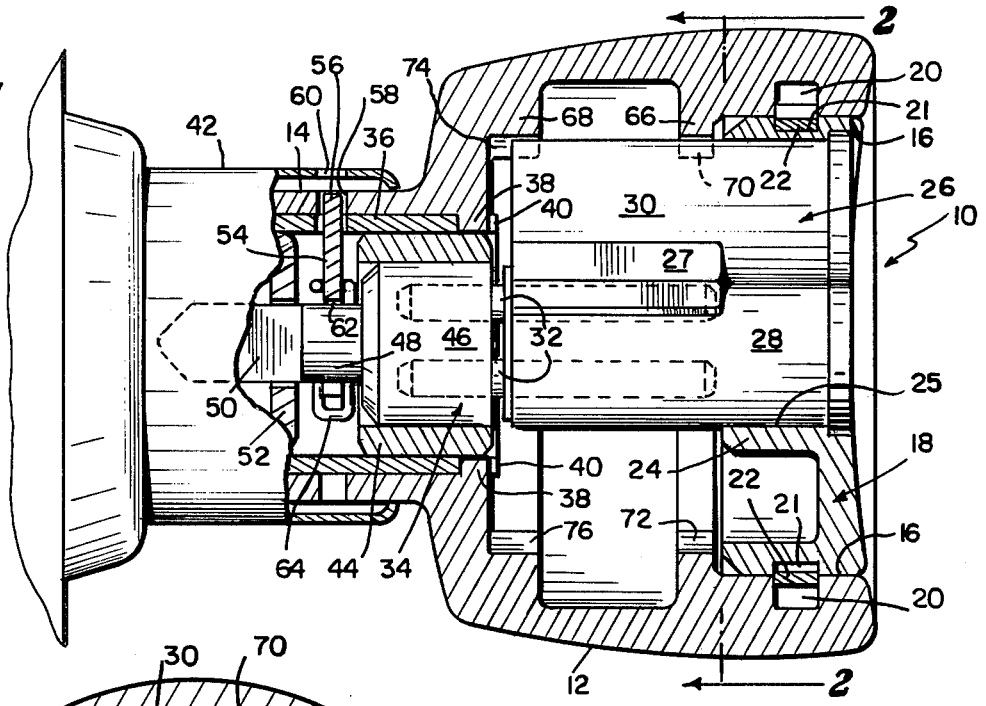
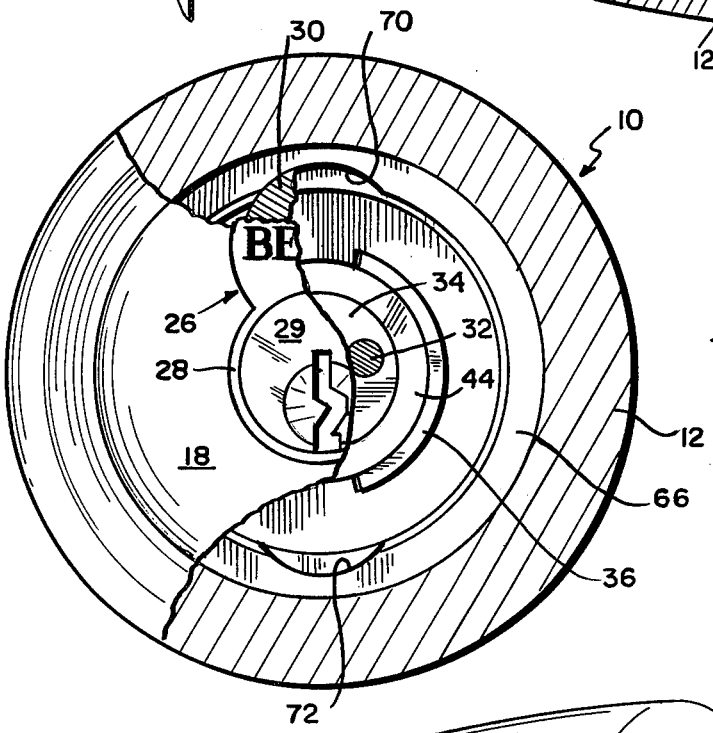
FIG. 2
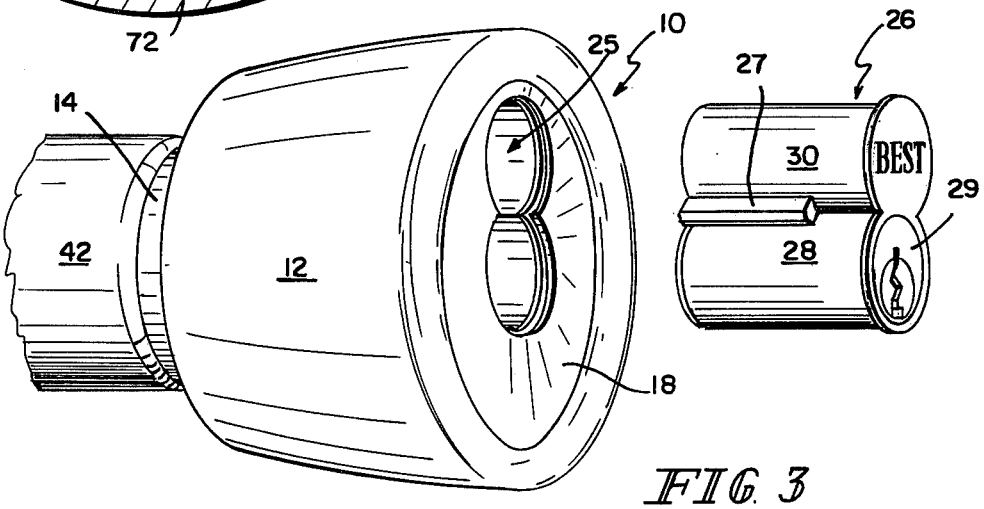
FIG. 3

DOORKNOB

This is a continuation-in-part of co-pending application Ser. No. 6/270,825, filed June 5, 1981, now Pat. No. 4,394,821 of Jul. 26, 1983, which is a continuation-in-part of application Ser. No. 6/136,746, filed Apr. 2, 1980, and now abandoned.

This invention relates to a doorknob adapted to receive and to itself position a key-operated core in either of two different orientations to suit doors of different hand.

Co-pending application Ser. No. 6/163,472, filed June 27, 1980, now Pat. No. 4,342,478 of Aug. 3, 1982, in FIG. 1, exemplifies a known type of knob having a fixed end face in which a key-operated core is receivable in only one orientation, so that the knob must be released and removed from the short knob sleeve on which it is mounted in order to change the orientation of the knob to suit doors of different hand. This is troublesome both to the manufacturer and distributors and to installers of lock sets provided with such knobs. In order to avoid difficulties at the time of lock installation, it is necessary for the manufacturer to prepare both left-hand and right-hand assemblies, and for both the manufacturer and the distributor to maintain inventories of both such assemblies.

FIGS. 6–8 of that same application Ser. No. 6/163,472 and applications Ser. Nos. 6/136,746 and 6/270,825 show a torque-releasable knob in which a long knob sleeve extends into engagement with the central collar of a face plate which is rotatably mounted in the end face of the knob, and the knob is rotatable relative to the core and end face so as to permit the knob to rotate under excessive torque. In this arrangement, the core and face plate are oriented by engagement of the core in one or the other of two diametrically opposite slots in the knob sleeve. This permits locks having such torque-releasable knobs to be manufactured, inventoried, and installed without regard for the hand of the door, and permits the proper orientation of the key-operated core and the face plate to be provided at the time of installation by simply rotating the rotatable face plate to the appropriate orientation and then inserting the key-operated core in a corresponding orientation. This is especially advantageous with cores of the type shown in those applications in which the core is a key-removable core.

Additionally, the knob construction shown on the torque-releasable knob, in which its end opening is closed by an end face secured with a trapped locking ring, is found to be advantageous over the use of a pressed-in-place face plate as shown in FIG. 1 of Ser. No. 6/163,472.

The present invention provides for the use of the improved knob construction in knobs which have previously embodied fixed end faces. It further makes available for such knobs the benefits of the different-hand orientation provided in the torque-releasable knob, including elimination of the necessity for manufacturing, inventorying, and distributing different lock sets to suit doors of different hand.

In accordance with the invention, a doorknob of the type which is mounted by its neck on a relatively short knob sleeve and keyed thereto to transmit torque from the knob to the knob sleeve is formed with a large end face opening in which a face plate is rotatable as in the torque-releasable knob, and the hollow hand-hold portion of the knob is formed axially inward of the face plate with means, such as an internal rib or flange or other radially inward extending structure, defining one or more inwardly open notches in position to be engaged by an eccentic portion of the lock core, for example, the pin tumbler portion of such core, mounted in the rotatable face plate. The core itself thus serves to key itself and the face plate to the knob against relative rotation. Two opposite notches are desirably provided so that the core and face plate can take two opposite orientations to suit doors of different hand.

The accompanying drawings illustrate the invention, and show a preferred embodiment exemplifying the best mode of carrying out the invention as presently perceived. In such drawings:

FIG. 1 is an axial vertical section showing a knob assembly and mounting embodying the present invention;

FIG. 2 is a section on the line 2—2 of FIG. 1; and

FIG. 3 is a perspective view of the knob of FIG. 1, with the key-operated core separated and in position for insertion in the knob.

The lock mechanism shown in FIGS. 1–3 comprises a knob 10 having a hand-hold portion 12 and a neck portion 14. The hand-hold is of heavy wall construction and formed with a large circular end face opening 16. A circular face plate 18 is mounted in such opening. The hand-hold wall forming the opening 16 and the outer periphery of the face plate 18 have facing circular grooves 20 and 21 in which a retaining ring 22 is trapped. The ring 22 is a resilient ring, and one of the grooves, preferably the outer groove 20, is sufficiently deep to permit that ring to be expanded into such groove as the face plate 18 is pressed axially into place. The inner end of the face plate may be beveled so as to cam the resilient ring 22 into the groove 20 until the two grooves come into alignment and thereby permit the ring to move to its interlocking position. The ring is shaped so as to cross between the two grooves repeatedly about the circumference of the face plate and thus secure the face plate in the opening 16 in a manner which permits free rotation of the face plate in the end of the knob. The central portion of the face plate 18 carries an inward-extending cylindrical boss 24, and the face plate is formed with a non-circular opening 25 for the reception of a key-removable core 26. The core is preferably of the type shown in FIG. 6 of Pat. No. 3,955,387. Such core is of figure-8 cross section and includes a retaining lug 27 which, in the present structure, engages behind the end of the cylindrical boss 24 to lock the core 26 in the face plate 18. The core includes a lower key plug lob 28 and an upper pin tumbler lobe 30. The key plug lobe is coaxial with the knob and contains a key plug 29 rotatable on that axis. The rear of the key plug has a pair of rearwardly open holes for the reception of throw pins 32 of a throw member 34 more fully described below.

Key-removable cores 26 are made in different lengths, with different numbers of pin tumbler columns. The longest of such key-removable cores is shown, but shorter cores can be accommodated by placing spacers on the throw pins 32 so as to hold the throw member 34 in proper axial position in the assembly.

The knob 10 is mounted by means of its neck 14 on a tubular knob sleeve 36, to which it is keyed by inward-extending keys 38 engaged in notches 40 in the knob sleeve. The end of the knob sleeve 14 is surrounded by a trim collar 42. The outer end of the knob sleeve is desirably mechanically strengthened by the insertion therein of a generally cylindrical support ring 44, and this serves as a bearing support for the cylindrical body 46 of the throw member 34 to which the throw pins 32 are fixed. The throw member has a cylindrical portion 48 of reduced diameter extending inward through the plane of the knob keeper, as described below, and has a flattened spade 50 engaged in a transverse slot in a key-actuated rollback sleeve 52. The knob neck 14 is retained on the knob sleeve 36 by a knob retainer 54, as more fully shown in application Ser. No. 6/163,472. The keeper 54 is mounted for radial movement in a plane normal to the axis of the sleeve 36 and has a radially projecting lug 56 which projects through a radial slot in the knob sleeve 36 and into an opening 58 formed in the neck 14 of the knob. Such a lug 56 and opening 58 may lie within the length of the collar 42, in which case such collar may be provided with an opening 60 for the insertion of a tool to force the keeper 54 out of engagement with the knob neck 14. The retainer 54 desirably has an inner edge 62 which extends into close proximity with the cylindrical portion 48 of the throw member so that such throw member, when in position as shown, will block movement of the keeper 54 to its knob-releasing position. The knob retainer 54 is biased to a knob-retaining position by a spring 64 of a type more fully shown and described in application Ser. No. 6/163,472. This arrangement provides that the knob will be normally locked onto the knob sleeve 36 and cannot be removed without first removing both the core 26 and the throw member 34 including both its cylindrical portion 48 and its spade 50.

In accordance with the present invention, the core 26 serves to key itself and the rotatable face plate 18 in one or more predetermined orientations in the knob, For this purpose, the interior of the hand-hold portion 14 of the knob is formed with one and preferably two inward-extending ribs or flange portions. In the structure shown, an innercircumferential rib 66 is formed at the inner end of the circular opening 16, close behind the face plate 18 rotatably mounted therein, so as to be engaged by either long or short cores. A similar inward-extending portion or rib 68 is formed at the rear portion of the hand-hold 12 of the knob to receive the rear portion of a long core, as shown. As shown, the rib 66 is formed with diametrically opposite cylindrical notches 70 and 72, and the inward-extending portion 68 is similarly formed with cylindrical notches 74 and 76. The inward-extending portions 66 and 68 extend inward sufficiently far to lie in interfering relation with a core 26 mounted in the knob, and the notches 70, 72, 74, and 76 form in effect a pair of opposite channels or spline grooves into which the core 26 is engaged as a key to lock the core 26 and face plate 18 against rotation in the hand-hold 12 of the knob.

The core and face plate may take either of two opposite orientations in the knob, and this will permit the core 26 to take the correct and desirable upright orientation in the knob when the lock set is mounted in either of the two alternative conditions it takes respectively in left-hand and right-hand doors. In the arrangement shown, the top lobe 30 of the core is engaged in the notches 70 and 74 which are at the top, to suit a door of a particular hand. When the lock set is installed in a door of different hand, the knob and chassis assembly become rotated 180°, and the knob is thus inverted from the position shown. If a core 26 is in place as shown in FIG. 1, this inversion will also invert the core to an upside down position, with the key plug lobe 28 at the top instead of at the botton. To correct this inversion, the core 26 is withdrawn from the knob with a special control key, the face plate 18 is rotated 180° so that the core-receiving opening is again in a proper upright position, and the core 26 is then reinstalled with the pin tumbler lobe 30 at the top. Since the knob has been inverted, the arcuate notches 72 and 76 inside the core will now be at the top, and the top lobe 30 of the core will enter those arcuate notches 72 and 76. The lock set and knob will then be in proper position for the door of different hand, with the core upright as shown.

The manufacturer normally packages lock sets without cores in place, and packages the cores separately. Distriubutors similarly stock cores separately from lock sets. With knobs embodying the present invention, lock sets are adapted to fit doors of either hand, without change other than rotation of the rotatable face plate 18 in the opening 16 of the knob of the lock set. Accordingly, the manufacturer need make no distinction between lock sets for left-hand and right-hand doors, and can package and ship lock sets indiscriminately for both applications. When the lock set is installed, the installer needs only to rotate the rotatable face plate 18 to an orientation in which the core-receiving opening is in upright position, and then to install a core 26. The core will key itself either into the arcuate notches 70 and 74, or into the notches 72 and 76, depending on which pair of notches happens to be at the top in the particular installation. It makes no difference in which position the knob 10 happens to be installed on the knob sleeve 36, nor whether the knob keeper 54 is in the upstanding position shown in FIG. 1, which occurs with doors of one hand, or is in the diametrically opposite downward position which it takes with doors of the opposite hand. In either case, there will be a pair of arcuate spline grooves 70, 74 or 72, 76 at the top of the knob chamber to receive the core 26 in a proper upright orientation. Accordingly, the manufacturer avoids any concern in manufacture, packaging, and distribution with respect to right- or left-hand installations, and chances of confusion in installation and service between lock sets adapted for different-hand installations are likewise eliminated.

What is claimed is:

1. A doorknob, comprising a body having a hand-hold portion and a neck, and mountable in a predetermined orientation on a knob sleeve or the like, said hand-hold portion being hollow and having a large circular end face opening, a face plate rotatably mounted in said opening and defining within itself an unsymmetrical opening adapted to removably receive a key-operable lock core, said knob being formed axially inward of said face plate with a notch in position to be engaged by an eccentric portion of a lock core mounted in said face plate so as to key the face plate and knob against relative rotation.

2. A doorknob as in claim 1 in which said knob is formed with two diametrically opposite core-engaging notches adapted to receive the eccentric portion of the lock core in two opposite orientations and thereby to position the rotatably mounted face plate and the lock core in two orientations in the knob to suit doors of different hand.

3. A doorknob as in claim 1 or 2 in which the core-receiving opening in the face plate includes a central portion for the reception of a key plug lobe of the core and a side portion for the reception of a pin tumbler housing of the core, and each said notch is positioned and adapted to be engaged by said pin tumbler housing.

4. A doorknob as in claim 1 or 2 in which the core-receiving opening in the face plate comprises a central lobe for the reception of the key plug lobe of a core of figure-8 cross section and a side lobe for the reception of the pin tumbler lobe of such a core, and each said notch is shaped and positioned to be engaged by the radially outward portion of such pin tumbler lobe.

5. A doorknob as in claim 3 in which the face plate is axially shorter than the cores it is adapted to receive so that a core mounted therein projects rearward beyond the face plate, and said notch-defining portions of the knob include portions positioned closely behind the face plate so as to be engaged by cores of different lengths.

6. A doorknob as in claim 4 in which the face plate is axially shorter than the cores it is adapted to receive so that a core mounted therein projects rearward beyond the face plate, and said notch-defining portions of the knob include portions positioned closely behind the face plate so as to be engaged by cores of different lengths.

7. A doorknob as in claim 4 in which said face plate defines a rearward-facing shoulder adjacent one side of the core-receiving opening adapted to be engaged by a retaining lug on the core to secure the core in place in the face plate.

8. A doorknob as in claim 7 in which said face plate and its surrounding knob body are formed with facing circumferential grooves, the face plate being fixedly but rotatably secured in the knob body by a locking ring contained in and crossing between said grooves.

9. A lock set having a doorknob for containing a key-operated lock mechanism and adapted to be mounted in opposite orientations in doors of different hand, comprising a hollow knob body mounted on a knob sleeve and connected to rotate such sleeve, said body having a large end opening, a face plate fixedly but rotatably mounted in said knob opening and defining within itself a core-receiving opening for the removable reception of a core having a key plug housing and a radially extending pin tumbler housing, such core-receiving opening having a central portion to receive the key plug housing and a side portion to receive the pin tumbler housing, fixed means within the knob defining a pair of diametrially opposite notches in position to be engaged selectively by the pin tumbler housing of a core mounted in the face plate so as to key the core and face plate to the knob in each of two opposite orientations and thereby to position the core and face plate in the same upright operating position in both of the two opposite orientations of the lock set and knob in doors of different hand.

10. A doorknob as in claim 9 in combination with a lock core of figure-8 cross section having a key-operable retaining lug movable between a retracted core-releasing position within the profile of the core and a projected core-retaining position beyond the profile of the core, said face plate opening being of corresponding figure-8 cross section and defining a rearward-presented shoulder behind which said retaining lug is engageable to secure the core in said fixedly mounted face plate and in keyed engagement with one of said notches.

* * * * *